US012796820B2

(12) United States Patent
MacNeil et al.

(10) Patent No.: US 12,796,820 B2
(45) Date of Patent: Nov. 17, 2026

(54) SEAT CUSHION

(71) Applicant: MACNEIL IP LLC, Bolingbrook, IL (US)

(72) Inventors: David F. MacNeil, Fort Lauderdale, FL (US); Stephen Kane, Cedar Lake, IN (US)

(73) Assignee: MACNEIL IP LLC, Bolingbrook, IL (US)

( * ) Notice: Subject to any disclaimer, the term of this patent is extended or adjusted under 35 U.S.C. 154(b) by 88 days.

(21) Appl. No.: 18/935,909

(22) Filed: Nov. 4, 2024

(65) Prior Publication Data

US 2026/0123755 A1 May 7, 2026

(51) Int. Cl.
*A47C 7/02* (2006.01)
*A47C 7/18* (2006.01)

(52) U.S. Cl.
CPC ..... *A47C 7/021* (2013.01); *A47C 7/18* (2013.01)

(58) Field of Classification Search
CPC ..... A47C 7/021; A47C 7/18
USPC ..... 297/183.1, 183.9, 180.11, 219.1, 228.1, 297/228.11
See application file for complete search history.

(56) References Cited

U.S. PATENT DOCUMENTS 1,802,853 A * 4/1931 Weltner ..... A47C 7/021 297/3
2,061,664 A * 11/1936 Lincoln ..... A47C 7/029 5/951
4,522,447 A * 6/1985 Snyder ..... A47C 7/18 297/452.32
4,557,522 A * 12/1985 Isikawa ..... A47C 7/18 297/218.2
4,588,229 A * 5/1986 Jay ..... A61G 7/05715 297/452.41
4,660,238 A * 4/1987 Jay ..... A47C 7/029 5/655.5
5,395,162 A * 3/1995 Jay ..... A47C 7/021 297/452.41
5,407,247 A * 4/1995 Forcier ..... A61G 5/1064 297/229
5,529,373 A * 6/1996 Olson ..... A47C 31/11 297/228.11
5,580,132 A * 12/1996 Rediske ..... A47G 23/0608 297/452.41
5,626,387 A * 5/1997 Yeh ..... B60N 2/58 297/180.12
6,015,471 A * 1/2000 Rimington ..... A61G 5/14 5/655.3
6,839,928 B1 * 1/2005 Woodall ..... A47C 5/125 5/656

(Continued)

FOREIGN PATENT DOCUMENTS

CN 212015108 U * 11/2020
JP H0736787 U * 7/1995

(Continued)

*Primary Examiner* — Jose V Chen
(74) *Attorney, Agent, or Firm* — Perkins IP Law Group LLC; Jefferson Perkins

(57) ABSTRACT

A seat cushion is integrally formed of a foamed elastomer. A hand cavity, by which the cushion may be carried, is positioned underneath a ridge of the cushion body. A flexible hanger strap may be threaded through a strap hole that extends from a ceiling of the hand cavity to the upper surface.

2 Claims, 6 Drawing Sheets

(56) References Cited

U.S. PATENT DOCUMENTS 6,929,325 B1 * 8/2005 Goelo ..... A47C 7/021 297/284.6
7,140,057 B2 * 11/2006 Hetzel ..... A61G 5/1043 5/653
7,216,388 B2 * 5/2007 Bieganek ..... A47C 7/029 5/653
7,373,678 B2 * 5/2008 Hetzel ..... A47C 7/021 5/655.4
7,694,788 B2 * 4/2010 Hann ..... B25H 3/02 297/256.16
7,819,484 B2 * 10/2010 Conforti ..... A47C 31/126 297/452.21
10,709,251 B1 * 7/2020 Rothman ..... A47C 7/18
D923,358 S * 6/2021 Leverett ..... D6/601
2009/0295203 A1 * 12/2009 Lewis ..... A61G 5/1045 297/219.1
2014/0182049 A1 * 7/2014 Prust ..... A42B 3/12 36/43
2015/0313782 A1 * 11/2015 Mulholland ..... A61G 5/127 297/183.1
2016/0183735 A1 * 6/2016 Liu ..... A47K 3/282 297/452.1
2020/0069063 A1 * 3/2020 Bates ..... A47C 15/004
2021/0022512 A1 * 1/2021 Vertuca, III ..... A47C 20/02
2021/0282557 A1 * 9/2021 Gleason ..... A47C 7/425
2022/0053944 A1 * 2/2022 Rajaratnam ..... A47C 27/16
2022/0232979 A1 * 7/2022 Qin ..... A47C 31/116
2024/0074584 A1 * 3/2024 Lowen ..... A47C 7/021
2026/0054625 A1 * 2/2026 Krivenkov ..... B60N 2/38
2026/0060431 A1 * 3/2026 Padilla ..... A47C 7/021

FOREIGN PATENT DOCUMENTS

JP 4893285 B2 * 3/2012 ..... B60N 2/585
WO WO-2024024674 A1 * 2/2024 ..... A47C 7/62

* cited by examiner

SEAT CUSHION

BACKGROUND OF THE INVENTION

The field of the invention relates to seat cushions, and particularly seat cushions molded of a foamed elastomer.

Stadium or bleacher seats can be hard, and where such seats are exposed to the elements, may be cold. Stadium seats and seat cushions have therefore been developed which may be transported by fans into the stadium for their personal use. A common seat cushion is simply a square of foamed elastomer which may be covered by a fabric. Improvements could still be made relative to ergonomics and ease of fabrication.

SUMMARY OF THE INVENTION

According to one aspect of the invention, a seat cushion has a body integrally molded of a foam elastomer. The body has an upper surface and an opposed lower surface. A rear margin of the body extends from the upper surface to the lower surface. A hand cavity is formed near the rear margin to upwardly extend into the body and is adapted to receive fingers of a human hand. The hand cavity has an upper surface that is downwardly spaced from the upper surface of the body. A hanger strap hole extends through the body from the upper surface of the hand cavity to the upper surface of the body. The hanger strap hole accepts an elongate flexible strap that his adapted to hand the seat cushion from a support for storage.

According to another aspect of the invention, a seat cushion is provided which has a body molded from a foamed elastomer. The body has an upper surface and an opposed lower surface. The body has a rear margin, a left margin forwardly extending from the rear margin, and a right margin that is opposed to the left margin and also forwardly extends from the rear margin. The rear, right and left margins extend downwardly from the upper surface of the body to the lower surface of the body. The body has a central depression. A ridge of the body is disposed between the central depression and the left, right and rear margins. The upper surface of the body is downwardly and inwardly sloped from the ridge to the central depression. A hand cavity is formed to upwardly extend from the lower surface of the body into the ridge and is adapted to receive a plurality of fingers of the human hand. The hand cavity has an upper surface downwardly spaced from the upper surface of the body. The hand cavity gives the user a place to grip the cushion for carrying, and positioning the hand cavity within the ridge will not decrease the cushionability of the seat overall.

BRIEF DESCRIPTION OF THE DRAWINGS

Further aspects of the invention and their advantages can be discerned in the following detailed description as read in conjunction with the drawings of exemplary embodiments, in which like characters denote like parts and in which.

DETAILED DESCRIPTION

Figure 1:
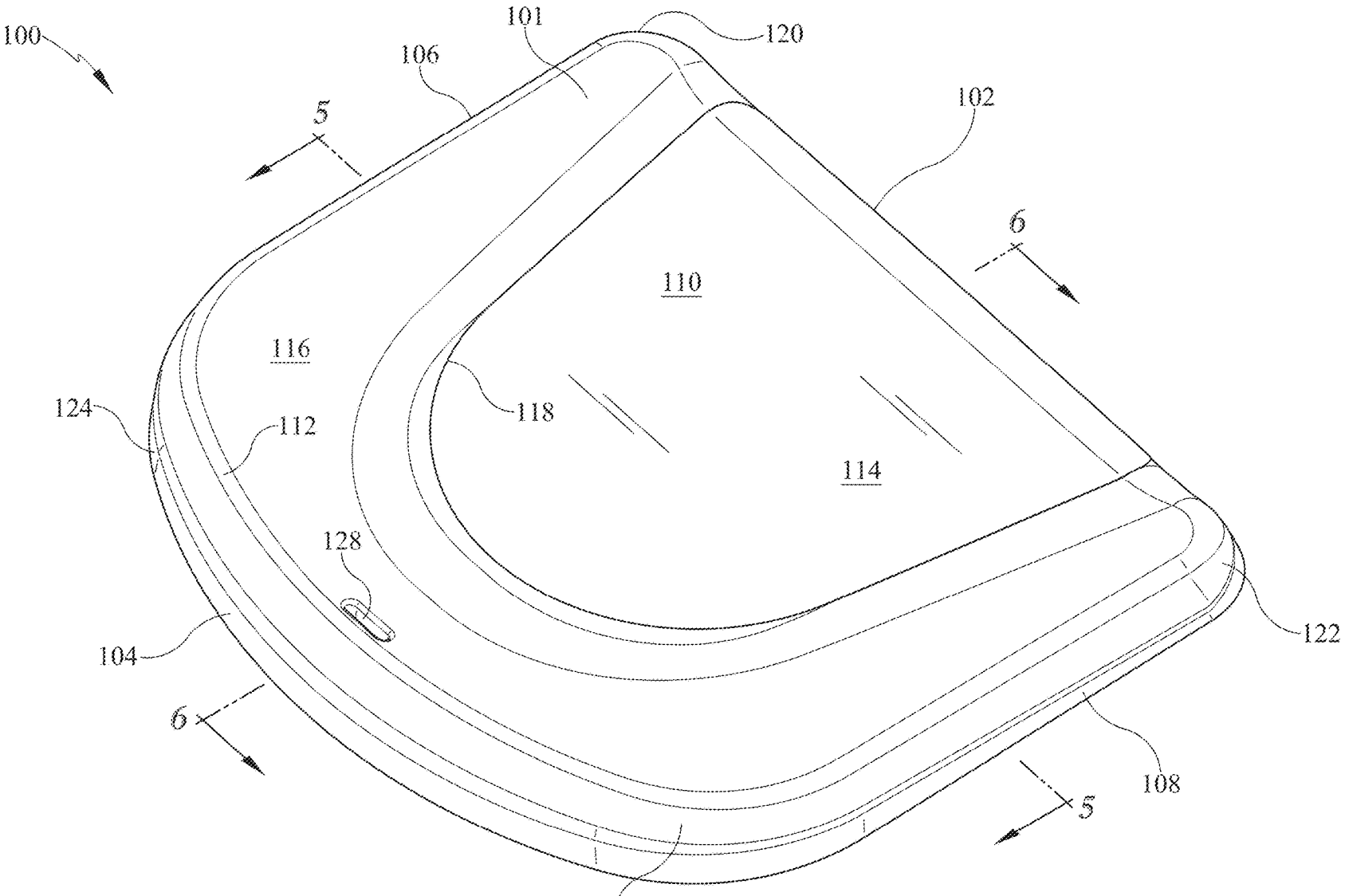
FIG. 1 is a rear top right perspective view of a seat cushion according to the invention.

As seen in FIG. 1, a seat cushion indicated generally at 100 has a body 101 with a front margin 102, an opposed rear margin 104, a left margin 106 that extends from front margin 102 to rear margin 104, and a right margin 108 that is opposed to left margin 106 and likewise extends from front margin 102 to rear margin 104.

The body 101 has a central depression 110 and, surrounding depression 110 on three sides, a ridge 112. An upper surface 114 of the body 101 includes a surface 116 which downwardly and inwardly slopes from ridge 112 to a boundary 118 of the central depression 110. Surface 116 better conforms to a user's seat than a flat plane and better distributes the user's weight.

Front margin 102 may be straight and may be joined to left margin 106 by a rounded corner 120. Front margin 102 may be joined to right margin 108 by a rounded corner 122. The rear margin 104 may be outwardly convexly curved and is joined to left and right margins 106 and 108 by respective curved transitions 124, 126 of larger radius than corners 120, 122. A hanger strap hole 128 may be positioned near rear margin 104 and may be disposed on a longitudinal center line 200 (FIG. 2) of the body 101.

Figure 2:
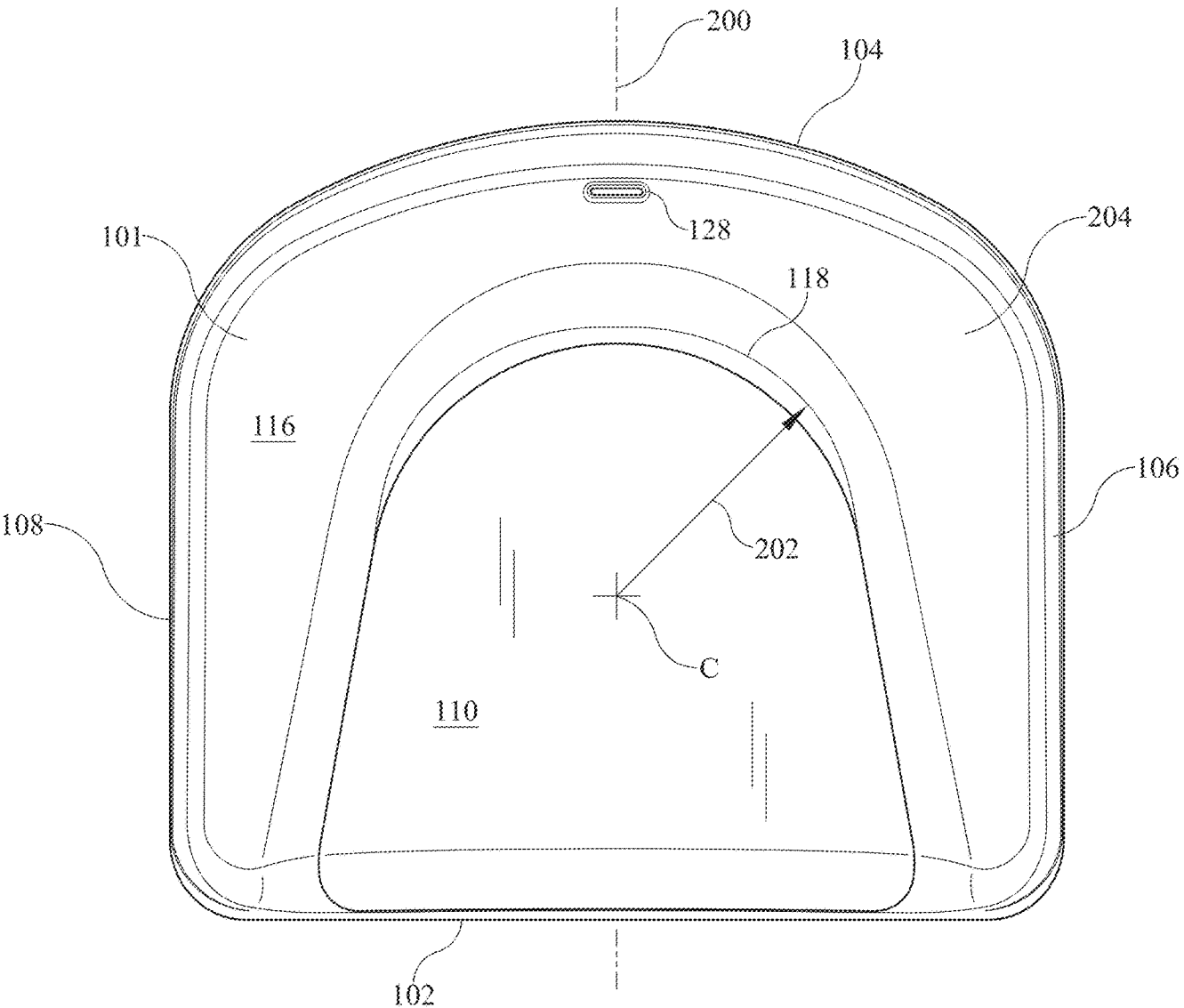
FIG. 2 is top view of the seat cushion shown in FIG. 1.

As seen in FIG. 2, a rear part of boundary 118 is curved, and may be elliptical or semicircular. A minimum radius 202 of the boundary 118 from body center C may be in the range of __ inches to __ inches and in the illustrated embodiment is about five inches.

The body 101 may be integrally molded from a foamed elastomer. More particularly, the body 101 may be cast using a molten foaming polyurethane. After hardening, the body 101 will have a fluid-impervious flexible skin 204 and a foamed interior 500 (FIGS. 5 and 6).

Figure 3:
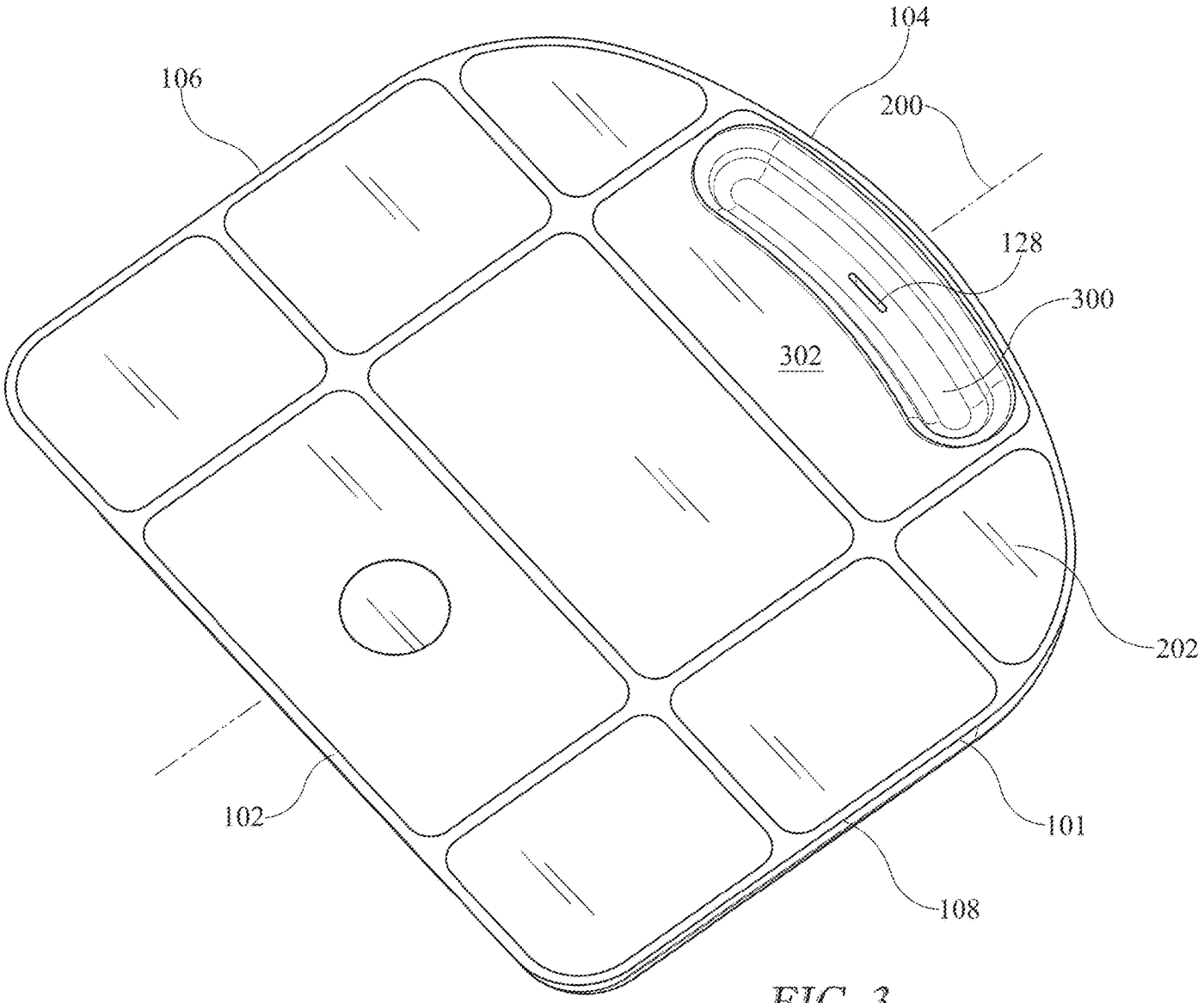
FIG. 3 is a bottom perspective view of the seat cushion shown in FIG. 1.

As seen in FIG. 3, a hand cavity 300 is formed to upwardly extend from a body lower surface 302. The hand cavity 300 may be positioned on center line 200 and near rear margin 104. The hand cavity 300 is sized to receive all four fingers of a typical human hand, or alternatively a thumb thereof. The hand cavity 300 should therefore be elongate in a transverse direction, and may be arcuate as shown in order to maintain its spacing from nearby rear margin 104. As seen in FIG. 6, the hand cavity 300 is rearwardly spaced from the central depression 110, so as to be disposed underneath ridge 112. This insures that at the location of hand cavity 300, there will still be an ample thickness of cushioning material above it. The hand cavity 300 has an upper surface or ceiling 600 that is downwardly spaced from upper surface 114 at all points.

Figure 4:
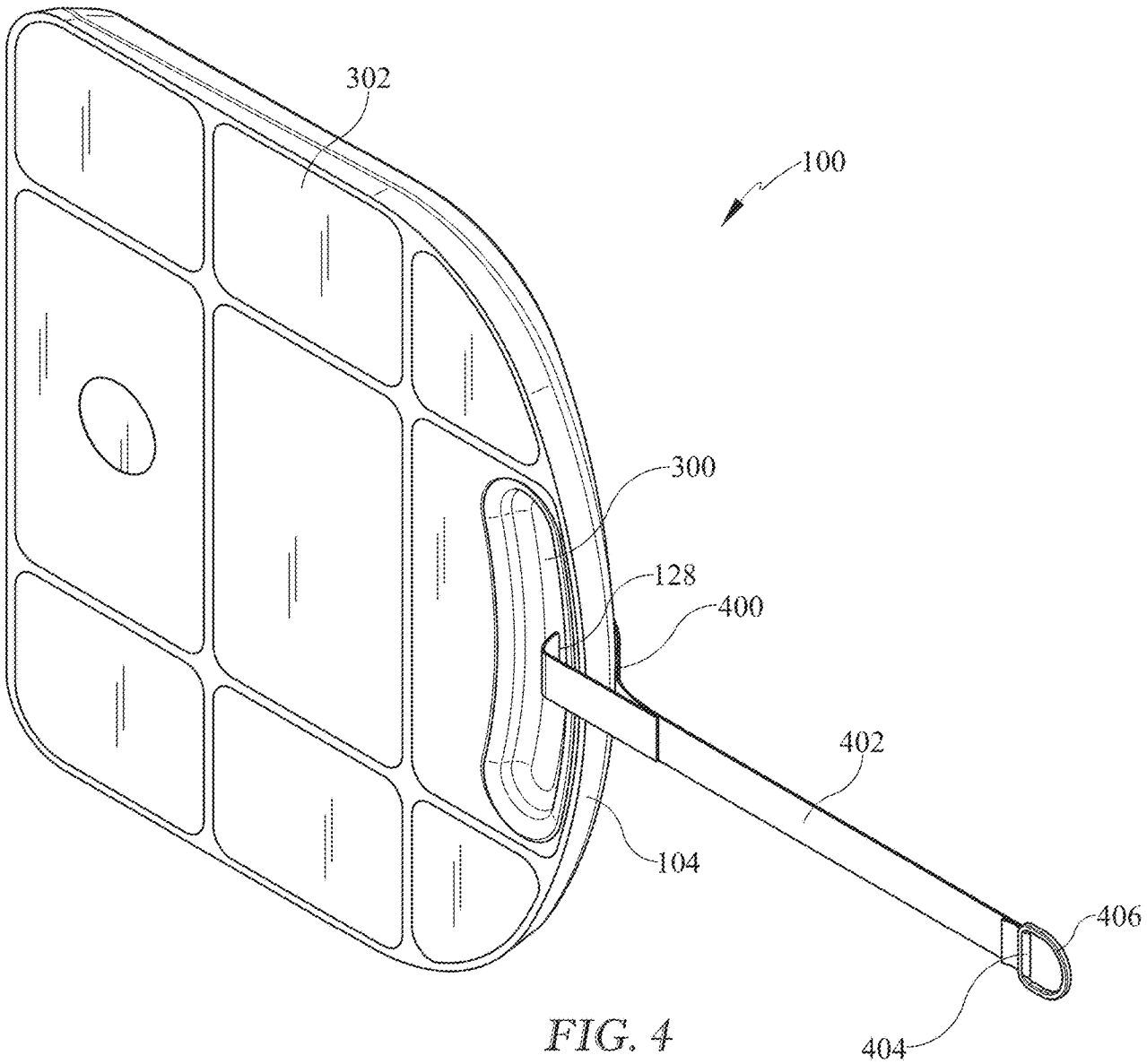
FIG. 4 is bottom front perspective view shown in FIGS. 1-3, but also showing a hanger strap.
Figure 6:
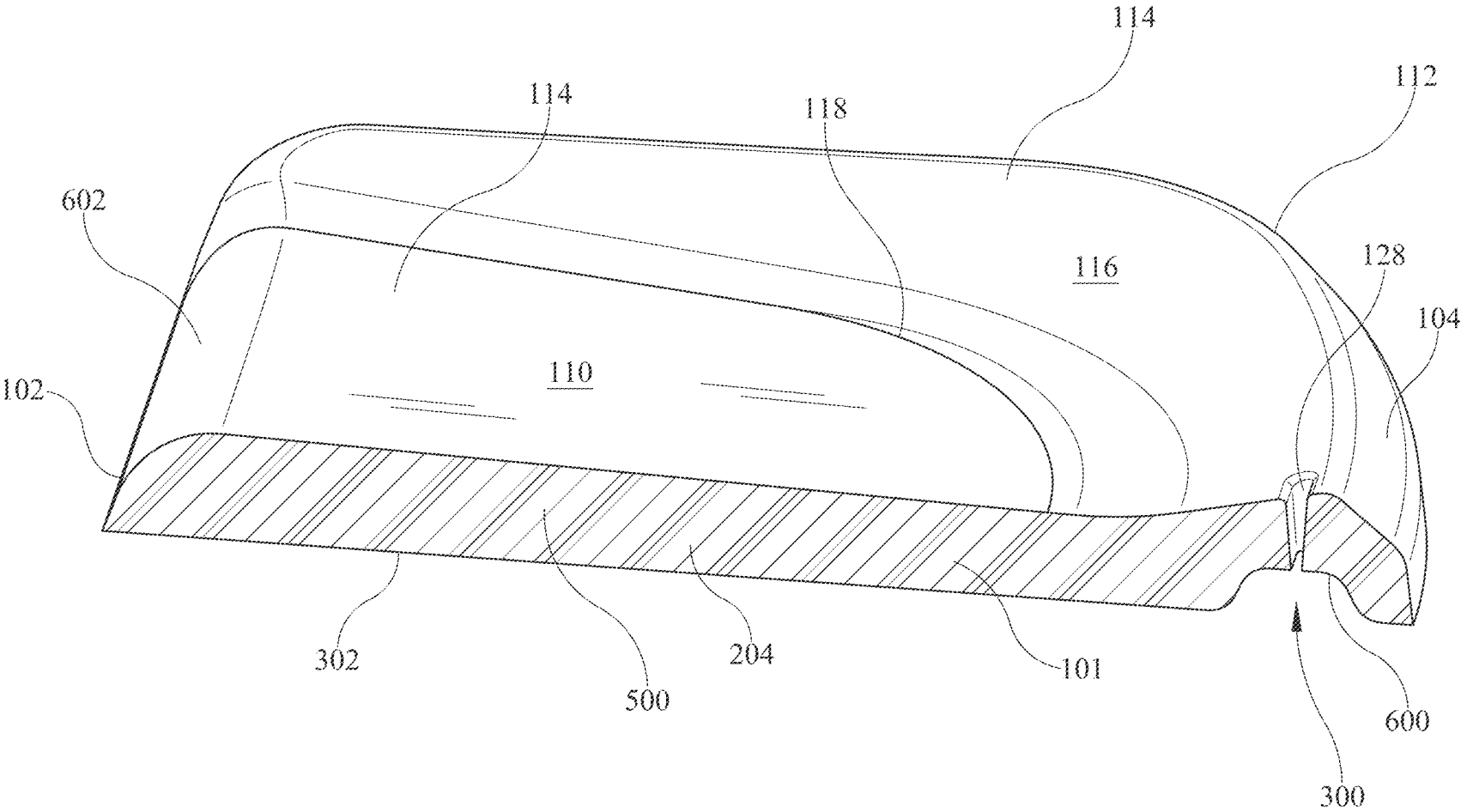
FIG. 6 is a longitudinal sectional view taken substantially along Line 6-6 of FIG. 1.

Also as best seen in FIG. 6, the hanger strap hole 128 is formed through body 101 from the hand cavity ceiling 600 to the upper surface 114. As seen in FIG. 4, a loop 400 of a flexible hanger strap 402 may be threaded through hanger strap hole 128 and hand cavity 300. A free end 404 of the hanger strap 402 may have a D-ring 406 which may be used to hang up cushion 100 on a hook, nail or other support for storage. The D-ring 406 and the strap 402 may also be used to transport the cushion 100.

Figure 5:
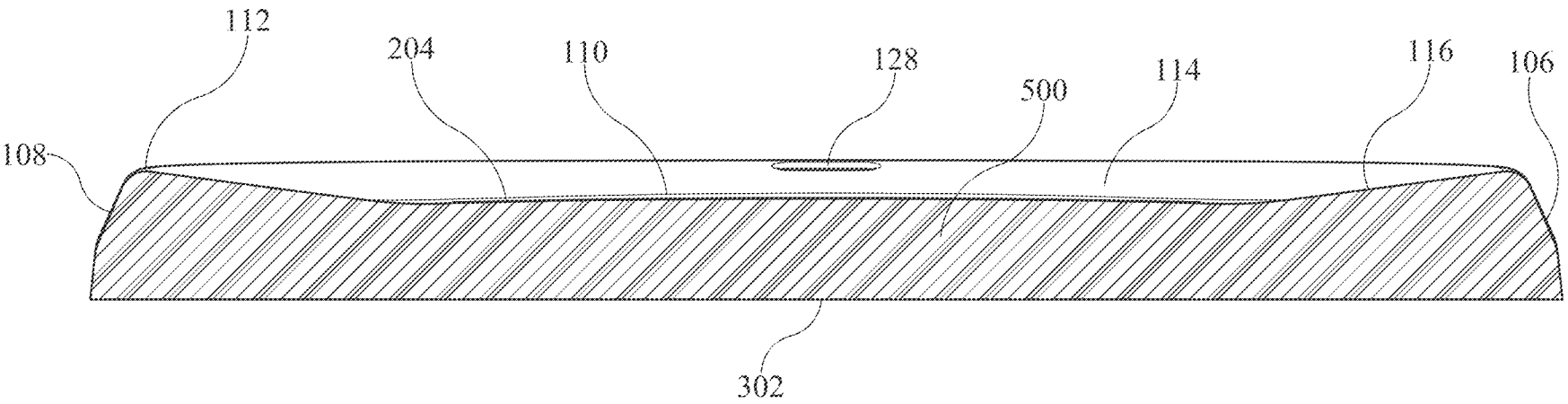
FIG. 5 is a transverse sectional view taken substantially along Line 5-5 of FIG. 1.

As seen in FIG. 5, which is a transverse or side-to-side sectional view, right margin 108 and left margin 106 each extend from upper surface 114 to lower surface 302. The lower surface 302 can be substantially flat. Within central depression 110, the upper surface 114 may be slightly upwardly convex.

As seen in FIG. 6, which is a longitudinal or front-to-rear sectional view, surface 114 makes an upwardly convex transition 602 from the central depression 110 to the front margin 102. The front margin 102 and the rear margin 104 each extend from upper surface 114 to lower surface 302.

In summary, a seat cushion integrally molded of a foamed elastomer has been shown and described. A central depression of the seat cushion is surrounded by a ridge, and a hand cavity is formed to upwardly extend into the body of the seat cushion underneath the ridge.

While an embodiment of the present invention has been described in the foregoing detailed description and illustrated in the appended drawings, the present invention is not limited thereto but only by the scope and spirit of the appended claims.

We claim:

1. A seat cushion comprising:

a body integrally molded of a foamed elastomer, the body having an upper surface and an opposed lower surface, the body having a rear margin extending from the upper surface to the lower surface;

a hand cavity formed near the rear margin to upwardly extend into the body and adapted to receive fingers of the human hand, the hand cavity having an upper surface downwardly spaced from the upper surface of the body;

a hanger strap hole extending from the upper surface of the hand cavity through the body to the upper surface of the body; and an elongate flexible hanger strap inserted through the hanger strap hole, the hanger strap adapted to hang the seat cushion from a support for storage.

2. The seat cushion of claim 1, wherein the foamed elastomer comprises polyurethane.

* * * * *